US005272838A

United States Patent [19]

Gibbs

[11] Patent Number: 5,272,838

[45] Date of Patent: Dec. 28, 1993

[54] GATE CONVERSION KIT

[75] Inventor: Edward L. Gibbs, Tulsa, Okla.

[73] Assignee: Ameristar Fence Products, Inc., Tulsa, Okla.

[21] Appl. No.: 823,353

[22] Filed: Jan. 21, 1992

[51] Int. Cl.[5] ..... E06B 11/00

[52] U.S. Cl. ..... 49/404; 49/410; 49/426; 403/292

[58] Field of Search ..... 49/404, 410, 411, 427, 49/426, 425, 501, 360; 16/96 R, 94 R, 95 R; 403/292

[56] References Cited

U.S. PATENT DOCUMENTS

| | | | |
|---|---|---|---|
| 1,073,563 | 9/1913 | Bemis | 49/427 X |
| 1,130,820 | 3/1915 | Hoffman | 16/95 R X |
| 2,732,919 | 1/1956 | Johnson, Jr. | 16/94 R X |
| 3,985,461 | 10/1976 | Gebhard | 403/292 |
| 4,628,638 | 12/1986 | Elko et al. | 49/426 |
| 4,716,693 | 1/1988 | Webster | 49/410 X |
| 4,723,374 | 2/1988 | Peterson et al. | 49/404 |
| 5,136,813 | 8/1992 | Gibbs et al. | 49/404 |

*Primary Examiner*—Philip C. Kannan

*Attorney, Agent, or Firm*—William S. Dorman

[57] ABSTRACT

A kit for converting a standard swing-type gate into a rolling cantilever-type gate. The kit consists of commercially available roller assemblies and guide roller assemblies with associated attaching hardware and a unique top-rail extrusion.

The top-rail extrusion is constructed in one piece with a flat ribbed side face having shoulders. Said shoulders either bolt directly to the gate in a horizontal orientation or attach to the gate horizontally with contoured brackets selected to fit the gate's structural members. One side of the top-rail extrusion is provided with a longitudinal compartment having a downward facing opening along its length. The compartment serves as a trackway for upper roller assemblies which are secured to support posts. Said upper roller assemblies access the compartment by way of the downward facing opening and support the gate.

Bottom guide roller assemblies also attach to the support posts and are positioned with at least one wheel of each guide roller assembly on each side of the gate's bottom gate rail.

7 Claims, 3 Drawing Sheets

Fig. 2
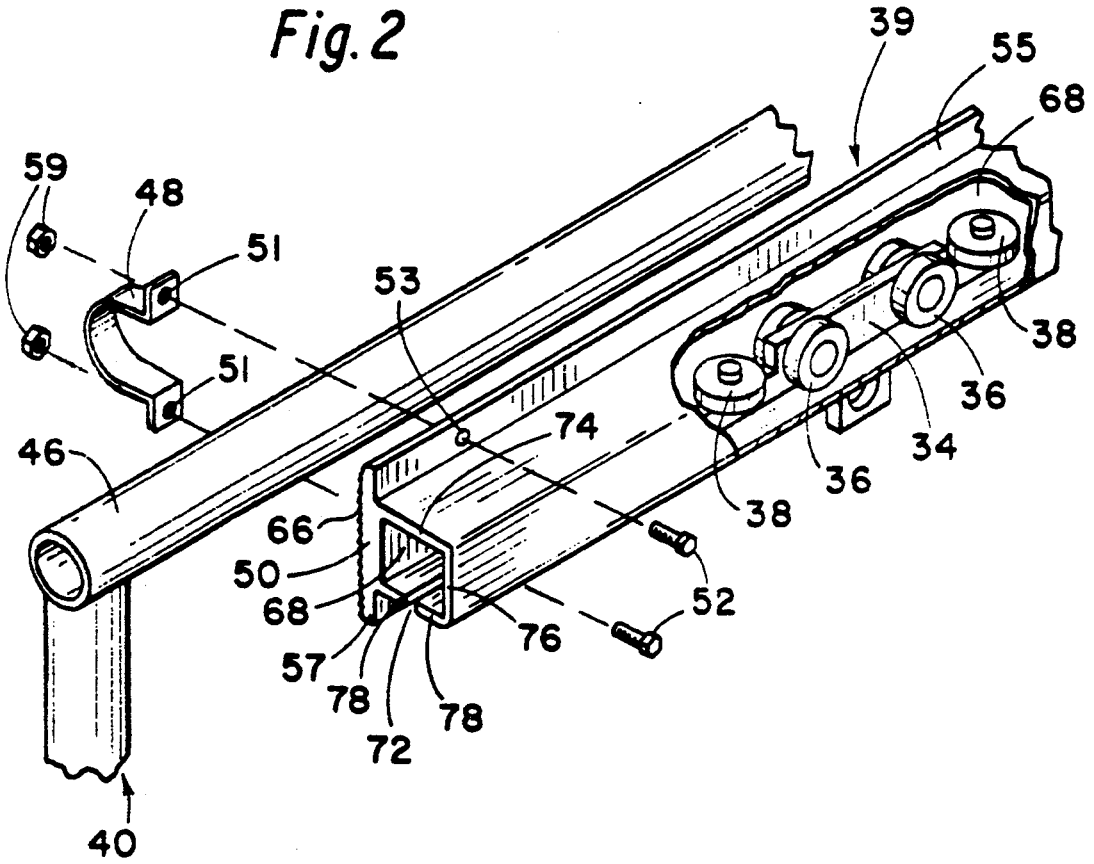
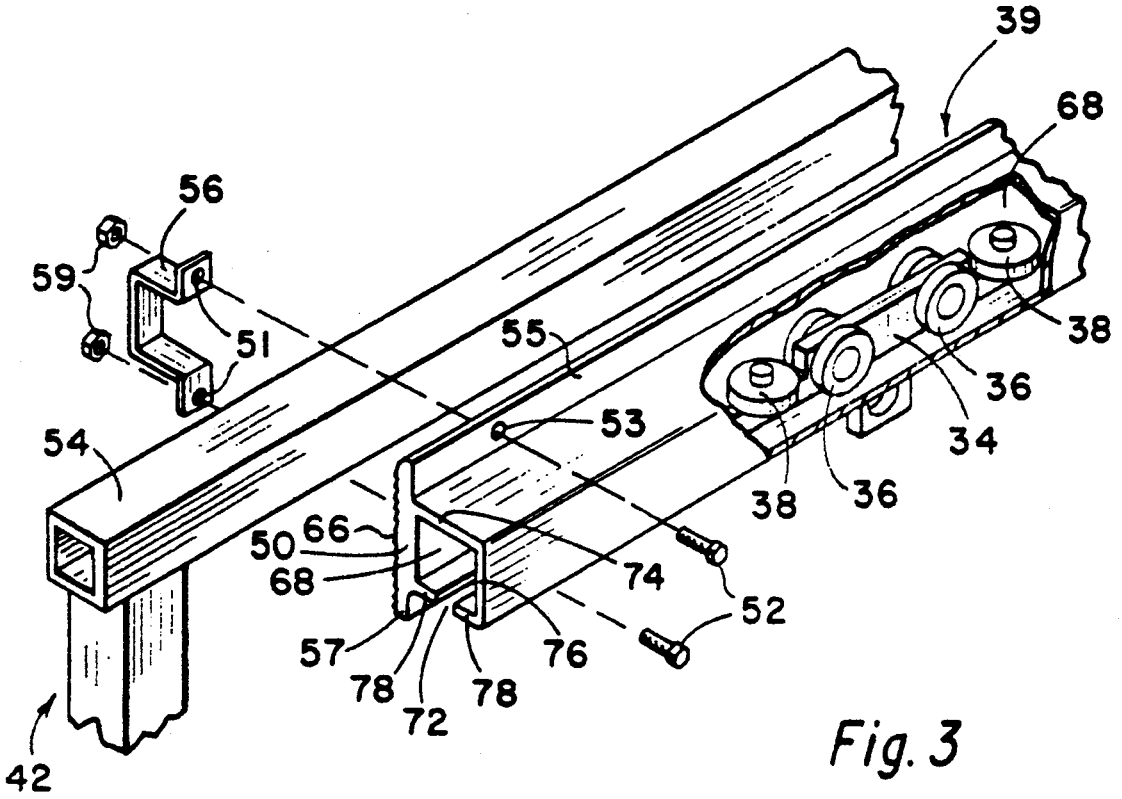
Fig. 3

Fig. 4
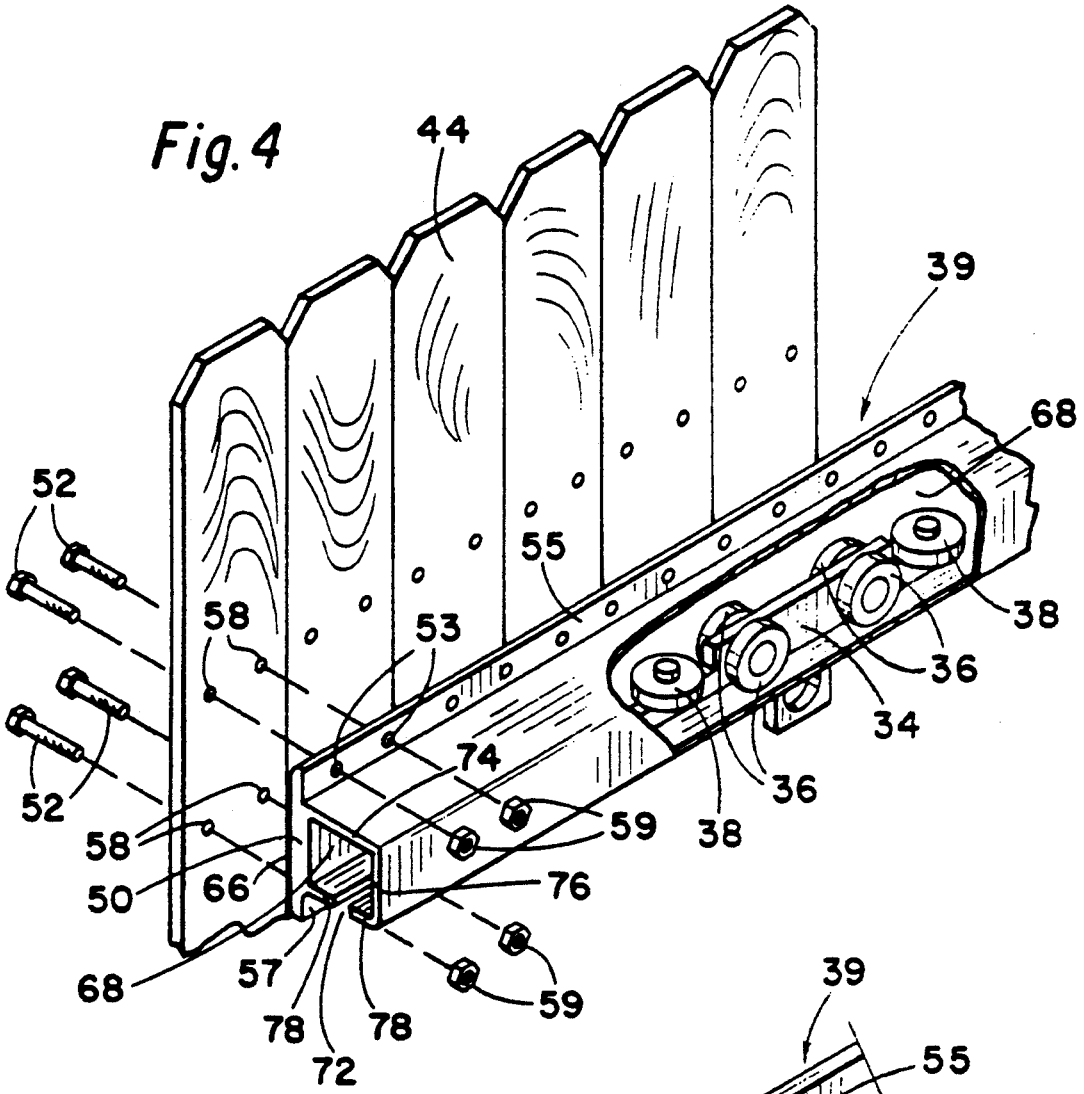
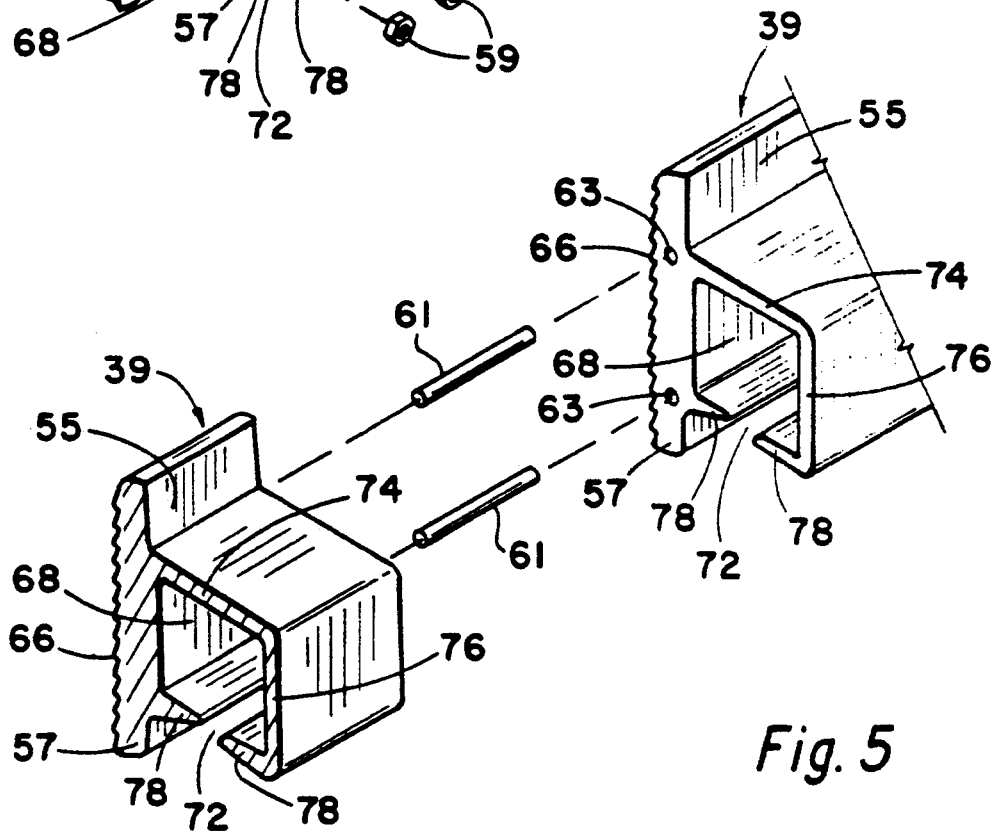
Fig. 5

GATE CONVERSION KIT

BACKGROUND OF THE INVENTION

1. Field of the Invention

The present invention relates to a conversion kit for converting an existing gate to a cantilever-type gate. More particularly, the present invention relates to a one-piece top-rail extrusion which can be fastened to an existing gate or panel to convert the gate or panel to a cantilever-type gate.

2. The Prior Art

Preliminary searches were conducted on the invention disclosed herein, and the following listed patents were uncovered in the searches:

| U.S. Pat. No. | Inventor | Issue Date |
|---|---|---|
| 1,077,269 | Gee | Nov. 4, 1913 |
| 1,276,602 | Widell | Aug. 20, 1918 |
| 1,347,438 | Bentzel | July 20, 1920 |
| 1,364,934 | Johnson | Jan. 11, 1921 |
| 1,544,555 | Chase | July 7, 1925 |
| 2,862,333 | Gardiol | Dec. 2, 1958 |
| 3,613,314 | Ford | Oct. 19, 1971 |
| 3,671,062 | Ashworth | June 20, 1972 |
| 3,985,461 | Gebhard | Oct. 12, 1976 |
| 4,628,638 | Elko | Dec. 16, 1986 |
| 5,022,185 | Oatman | June 11, 1991 |

Cantilever gates have been known for some time. Generally, these are new gates being used in new installations or, when used with an existing perimeter fence, the old conventional swing-type gate is completely replaced with a new cantilever-type gate.

A conversion kit is revealed in U.S. Pat. No. 4,628,638 for converting a conventional gate to a cantilever-type gate. However, several problems exist in prior art conversion kits.

Existing conversion kits have an enclosed compartment consisting of more than one piece. These pieces must be secured together to form the compartment which serves as an enclosed track for upper roller assemblies. The upper roller assemblies are attached to supporting posts and extend up into the compartment through a downward facing opening in the compartment.

One problem with existing conversion kits is that the enclosed compartment consists of more than one piece which must be secured together either by welding which increases the cost and complexity of installation, or secured together with bolts or rivets which can become easily loosened resulting in a distorted compartment and a cantilever gate which does not slide easily.

The present invention overcomes this problem by utilizing a one-piece top-rail extrusion which retains its shape and permits the gate to roll freely between the open and closed positions.

Also, existing conversion kits must be custom made to the contour of the gate's frame because both the enclosed compartment's side face which engages the gate and the bracket which secures the compartment to the gate are configured to conform to the contour of the upper rail of the gate. Variations in shape or diameter of the upper rail of the gate necessitate customizing these two pieces of the kit, increasing the cost and time required to complete the conversion.

The present invention overcomes this problem by utilizing a flat vertical face on the top-rail extrusion and using commercially available standard curved or standard square shouldered brackets to accommodate different sized and different shaped upper gate rails.

Finally, existing conversion kits have no provision for use with a solid gate which has no upper gate rails for the enclosed compartment's side face to fasten against, such as a wooden privacy gate.

The present invention's flat vertical face easily bolts to a solid gate. Also, because more than one top-rail extrusion can be fastened together with splines, even conversion kits for extremely long gates can be transported in easily handled bundles to the job site where they can be used to quickly and economically convert existing gates to cantilever-type gates using standard tools.

The remaining listed patents are not deemed sufficiently pertinent to warrant discussion of them.

3. Cross-Reference to Related Applications

Application Ser. No. 07/763,801, filed Sep. 23, 1991, now U.S. Pat. No. 5,136,813, issued on Aug. 11, 1992, for a "Cantilever-Type Sliding Gate" by the inventor of the present invention is of interest in that it discloses a one-piece top-rail extrusion.

SUMMARY OF THE INVENTION

The present invention is a conversion kit for transforming a conventional swing-type gate or gate panel into a cantilever-type gate. The kit includes a unique one-piece top-rail extrusion, commercially available roller assemblies, and hardware for attaching the top-rail extrusion to the existing gate.

The top-rail extrusion has a vertical face or plate with two sides, one side having horizontal ribs which engage the upper support member of gates having upper support members, or the solid surface of gates with no upper support members. Said vertical face or plate is provided with a compartment on its other side. The top-rail extrusion has shoulders extending above and below the compartment, said shoulders are provided with holes through which bolts extend to fasten the top-rail extrusion to the gate.

For gates with upper support members, the top-rail extrusion is fastened to the gate by means of brackets having holes through which the bolts extend before nuts are tightened on the bolts. The brackets used to secure the top-rail extrusion to the gate are contoured to the shape of the upper support member, i.e. curved brackets are used for round upper support members and square shouldered brackets are used for square upper support members.

For gates having no upper support members, holes are drilled in the gate, and the top-rail extrusion is bolted directly to the gate by inserting the bolts through the holes in the gate and through either the holes in the upper or lower shoulders before tightening the nuts thereon.

The compartment has a downward facing opening by which truck assemblies of upper roller assemblies extend into the compartment and support the gate on support posts to which the upper roller assemblies are fastened. The compartment serves as a track in which wheels of the truck assemblies travel, thus moving the gate between an open and closed position.

Bottom guide roller assemblies attach to the support posts and are positioned with at least one wheel on each side of the gate's bottom rail, thus limiting the sideways movement of the gate as it moves between open and closed positions.

BRIEF DESCRIPTION OF THE DRAWINGS

FIG. 2 is a enlarged perspective view of a gate conversion kit according to the present invention for use with a round frame member gate.

FIG. 3 is an enlarged perspective view of a gate conversion kit according to the present invention for use with a square frame member gate.

FIG. 4 is an enlarged perspective view of a gate conversion kit according to the present invention for use with a solid wooden gate.

FIG. 5 is an enlarged perspective view showing how two pieces of top-rail extrusion can be fitted together to form a longer cantilever-type gate.

DETAILED DESCRIPTION OF THE PREFERRED EMBODIMENTS

Figure 1:
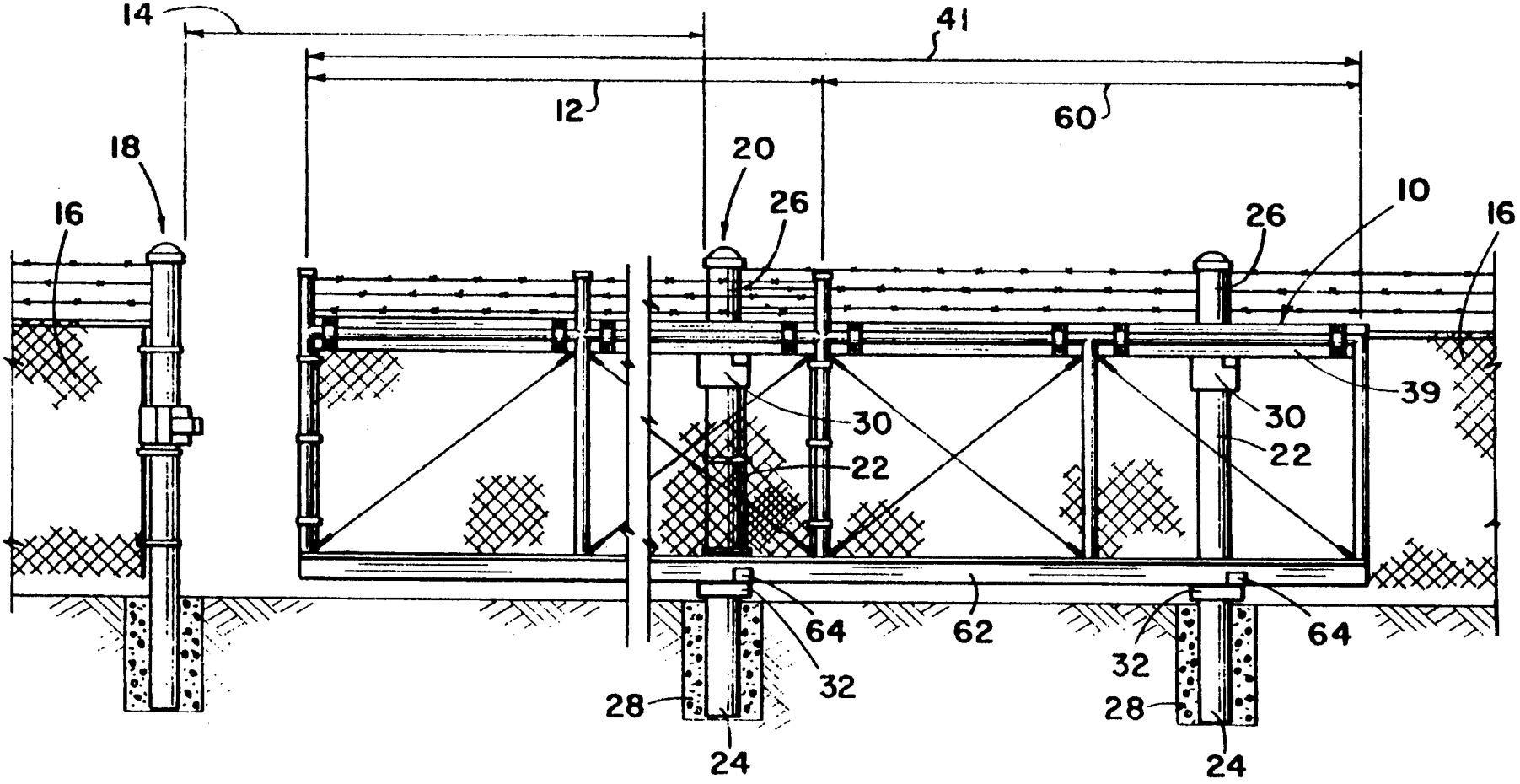
FIG. 1 is a front view of a gate conversion kit according to the present invention installed on a round frame member gate.

Referring now to FIG. 1, a gate conversion kit 10 which incorporates the teaching of the present invention, is shown on a conventional type gate 12. The general environment for the invention includes a gap 14 to be spanned, typically a roadway, and a perimeter fence 16, often of the chain-link variety, located on each side of the gap 14 and defining the gap 14. One side of the gap 14 is defined by a gate-receiving side 18 of the fence 16 and the other side of the gap 14 is defined by a gate-supplying side 20 of the fence 16.

Generally, at least two support posts 22 are located on the gate-supplying side 20 of the fence 16, one located adjacent to the gap 14 to be spanned and the other spaced some distance from the first post 22 in a plane adjacent to the gate-supplying side 20 of the fence 16 and parallel to the gap 14 to be spanned.

Said support posts 22 define the plane in which the gate 12 will slide when supported by said support posts 22. The support posts 22 each have two ends, a bottom end 24 and a top end 26. The bottom ends 24 are securely fastened to the earth with concrete 28 or other suitable means, and the top ends 26 extend into the air, perpendicular to the earth.

Each support post 22 has an upper roller assembly 30 attached near the top end 26 and a bottom guide roller assembly 32 attached near the bottom end 24.

Referring now to FIGS. 2, 3 and 4, each upper roller assembly 30 has a flexibly mounted truck assembly 34 extending upward from it. The truck assembly 34 has vertically mounted support rollers 36 located adjacent to each other and horizontally mounted support rollers 38 located adjacent to the vertically mounted support rollers 36.

Referring to FIG. 1, the gate conversion kit 10 includes a top-rail extrusion 39 which can be attached horizontally to an existing gate 12 to convert it to a cantilever-type gate 41. As shown in FIGS. 2, 3 and 4, the top-rail extrusion 39 can be used with a round frame member gate 40, with a square frame member gate 42 or with a solid gate 44 such a wooden privacy gate.

As shown in FIG. 2, the top-rail extrusion 39 is attached to a round upper support member 46 of the round frame member gate 40 by means of curved brackets 48 which fit around the, round upper support member 46 and attach to a vertical face or plate 50 of the top-rail extrusion 39 by means of bolts 52; said bolts 52 extend through holes 53 in an upper shoulder 55 and a lower shoulder 57 of the top-rail extrusion 39 and through holes 51 in the brackets 48. The bolts 52 are provided with nuts 59 for securing the bolts 52.

FIG. 3 shows the top-rail extrusion 39 attached to a square upper support member 54 of the square frame member gate 42 by means of a square shouldered bracket 56 which fits around the square upper support member 54 and attaches to the vertical face 50 of the top-rail extrusion 39 by means of bolts 52 extending through holes 53 and 51.

FIG. 4 shows the vertical face 50 of the top-rail extrusion 39 attached directly to the solid wooden gate 44 by means of bolts 52 extending through holes 58 drilled in the solid wooden gate 44 and extending through holes 53.

As shown in FIG. 1, the installed top-rail extrusion 39 extends beyond the original gate 12 and runs along an added cantilever portion 60 of the cantilever-type gate 41, said cantilever portion 60 being the same length as the distance between the two support posts 22.

As shown in FIG. 5, for particularly long applications, longer cantilever-type gates 41 can be made by joining two shorter pieces of top-rail extrusion 39 together with their ends abutting by utilizing splines 61 which insert into drilled receiving holes 63 in the abutting ends of the top-rail extrusions 39.

The added cantilever portion 60 is usually a rectangular frame which is either welded, bolted or similarly attached to the original gate 12. The purposes for adding the cantilever portion 60 are to extend the length of the gate, to provide a place of attachment for the top-rail extrusion 39 and to provide a bottom gate rail 62 for the cantilever portion 60.

The bottom gate rail 62 serves as a track for guide wheels 64 which are movably attached to the bottom guide roller assemblies 32. The guide wheels 64 are positioned on each side of the bottom gate rail 62 so that the cantilever-type gate 41 can roll only between the guide wheels 64 in a plane parallel to the gap 14 to be spanned, thus preventing sideways movement of the gate as it moves between its open and closed positions.

Now referring specifically to the top-rail extrusion 39 as illustrated in FIGS. 2, 3 and 4, the top-rail extrusion 39 is a one-piece extrusion of aluminum or other suitable material. The vertical face 50 is flat and is not contoured to either the round upper support member 46 or the square upper support member 54, thus enabling the same top-rail extrusion 39 to be used, on any type of gate. The vertical face 50 adjacent to fence member 46, 54, or 44 is provided with horizontal ribs 66 which serve to grip the gate 12 and prevent the top-rail extrusion 39 from slipping.

The vertical face 50 has a compartment 68 attached to its side opposite where the horizontal ribs 66 are located. The upper shoulder 55 of the vertical face 50 extends above the compartment 68, and the lower shoulder 57 of the vertical face 50 extends below the compartment 68. The two shoulders 55 and 57 provide means for attaching the top-rail extrusion 39 to the gate 12.

The compartment 68 is open at both ends of the top-rail extrusion 39 and has a downward facing opening 72 which extends horizontally along the top-rail extrusion 39 for its entire length. The compartment 68 is formed from the vertical face 50 which forms one side wall of the compartment 68, a solid horizontal top wall 74 attached to the vertical face 50, a solid vertical side wall 76 attached to the horizontal top wall 74 and parallel to the vertical face 50, and two horizontal lower lips 78 which are parallel to the solid horizontal top wall 74 and which form the bottom of the compartment 68. One of the horizontal lower lips 78 is attached to the vertical side wall 76 and the other horizontal lower lip 78 is attached to the vertical face 50 on the same side of the vertical face 50 to which the horizontal top wall 74 attaches. The two horizontal lower lips 78 are separated from each other so as to form the downward facing opening 72 between them.

The compartment 68 has sufficient internal dimensions to accommodate without binding the truck assembly 34 and rollers 36 and 38 which extends up into the compartment 68 by way of the downward facing opening 72, said downward facing opening 72 being wide enough to admit the truck assembly 34 without binding. During assembly, the truck assemblies 34 are initially introduced into the compartment 68 at one end of the top-rail extrusion 39. The compartment 68 serves as an enclosed track in which the vertically mounted support rollers 36 and the horizontally mounted support rollers 38 travel as they roll, thus moving the cantilever-type gate 41 between an open and closed position.

In view of the foregoing description, it should appear that all of the components of the gate conversion kit 10, i.e. the top-rail extrusion 39, the upper roller assemblies 30, the bottom guide roller assemblies 32, and the associated brackets, bolts and other attachment hardware, can be shipped disassembled in a single palletized bundle of sufficiently restricted length and size to be easily transported, and the gate conversion kit 10 can be assembled on site using standard tools to convert a conventional gate 12 into a cantilever-type gate 41.

Whereas, the present invention has been disclosed in terms of the specific structure described above, it should be understood that other and further modifications, apart from those shown or suggested herein, may be made within the spirit and scope of this invention.

What is claimed is:

1. A gate conversion kit for converting a conventional swing-type gate to a cantilever-type gate for spanning an opening defined by a gate-receiving side and a gate-supplying side of a perimeter fence comprising a one-piece horizontal top-rail extrusion having a flat vertical plate for engaging the gate along a first side of the plate and in general parallel alignment with the gate, a compartment extending horizontally along the top-rail extrusion for its entire length, said compartment attached to the vertical plate on a second side of said plate opposite the side which is adapted to engage the gate, said compartment having a downward facing opening extending parallel to the plate and formed by two horizontal lower lips, an upper shoulder on the vertical plate extending above the compartment, a lower shoulder on the vertical plate extending below the compartment, the upper and the lower shoulders being provided with holes to permit connection to said gate, at least one upper roller assembly adapted to be secured to a supporting post located on the gate-supplying side of the fence, said upper roller assembly engaging the compartment through the downward facing opening for supporting the gate and for moving the gate between open and closed positions.

2. A gate conversion kit according to claim 1 wherein the vertical plate is provided with horizontal ribs on said first side.

3. A gate conversion kit according to claim 1 further comprising bolts adapted to extend through holes in the gate and extending through holes in the upper shoulder and bolts adapted to extend through holes in the gate and extending through holes in the lower shoulder, said bolts being secured by nuts.

4. A gate conversion kit according to claim 1 wherein the top rial extrusion is adapted to be secured by brackets contoured to the shape of an upper support member, said brackets provided with holes though which bolts extend, said bolts also extend through holes in the upper shoulder and holes in the lower shoulder to secure the brackets around the upper support member and against the vertical face of the top-rail extrusion, said bolts being secured by nuts.

5. A gate conversion kit according to claim 1 wherein the compartment is provided with a solid horizontal top wall attached to the vertical plate on the second side thereof, a solid vertical side wall attached to the horizontal top wall, one of the horizontal lower lips being attached to the solid vertical side wall, the other horizontal lower lip being attached to the second side of the vertical plate.

6. A gate conversion kit according to claim 2 further comprising at least one bottom guide roller assembly adapted to be secured to said supporting post, said bottom guide roller assembly movably engageable with a bottom gate rail in order to limit the side to side motion of the gate as it moves between open and closed positions.

7. A gate conversion kit according to claim 2 further comprising at least two horizontally extending top-rail extrusions provided with drilled receiving holes at their abutting ends, said top-rail extrusions being secured together in an end-to-end relation by means of splines inserted in the drilled receiving holes.

* * * * *